United States Patent [19]

Orter

[11] 4,252,322

[45] Feb. 24, 1981

[54] BINGO BOARD WITH BONUS GAMES FEATURE

[76] Inventor: Ralph H. Orter, P.O. Box 2074, Prescott, Ariz. 86301

[21] Appl. No.: 956,225

[22] Filed: Oct. 30, 1978

[51] Int. Cl.[3] ..... A63F 3/06

[52] U.S. Cl. ..... 273/269

[58] Field of Search ..... 273/269, 270, 271

[56] References Cited

U.S. PATENT DOCUMENTS

| | | | |
|---|---|---|---|
| 3,975,021 | 8/1976 | Brown | 273/271 |
| 4,019,744 | 4/1977 | Pizur | 273/269 |

*Primary Examiner*—Anton O. Oechsle

[57] ABSTRACT

A bingo playing board provided on its front face with a rectangular matrix of spaces, at least a majority of which are numbered. The spaces are disposed in discrete rows and columns with letters separately associated with and identifying respective ones of said columns to define a bingo game format. Additional numbered spaces may be provided outside of the rectangular matrix. Selected ones of the numbered spaces within the matrix, or outside the matrix, or both, are physically designated as bonus numbers to allow the playing of additional games while playing the game of bingo.

7 Claims, 4 Drawing Figures

BINGO BOARD WITH BONUS GAMES FEATURE

BACKGROUND OF THE INVENTION

The game of bingo is conventionally played by players each provided with one or more boards who attempt to be the first player to cover a specified arrangement of numbers on their boards in response to the numbers being chosen at random. While the game as conventionally played is interesting and exciting to a large number of devotees of the game, the improvements to the game as described herein are intended to make the game even more entertaining.

SUMMARY OF THE INVENTION

It is a principal object of the present invention to provide modified forms of bingo boards which allow the playing of additional games while playing a more conventional form of the game.

DESCRIPTION OF THE PREFERRED EMBODIMENTS

FIGS. 1–4 respectively show four preferred modes of carrying out my invention. Each figure shows a rectangular matrix of evenly disposed numbered spaces with the spaces disposed in discrete rows and columns. A letter is separately associated with and indentifies each column of numbered spaces. The arrangement described thus far is more or less that of a conventional bingo game format arrangement which my invention is intended to improve upon. My invention consists in the provision and identification of bonus numbers included within and/or without the above described rectangular matrix. In all of the Figures, the ordinary bingo numbered spaces are designated as 1 and the conventionally centrally disposed "free" space is designated as 4.

Figure 1:
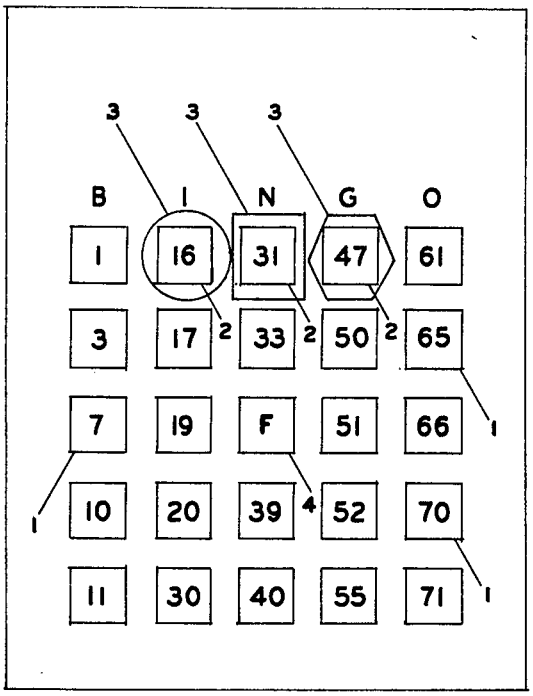
FIGS. 1–4 are top plan views of four preferred forms of modified bingo boards in accordance with the present invention.
Figure 3:
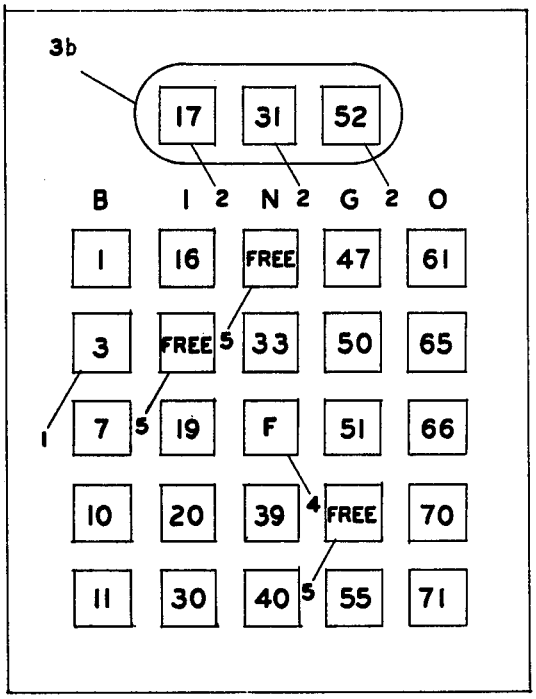

In FIG. 1, the bonus numbered spaces 2 are identified by being enclosed within geomertic outline symbols or figures 3. The enclosing geometric symbols can be formed as circles, squares, triangles or any other symbol which would serve the same identifying purpose.

Figure 2:
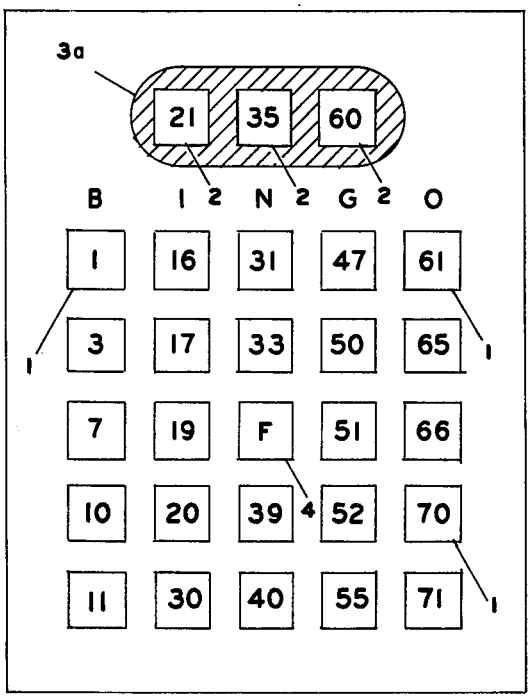

In FIG. 2, the bonus numbered spaces 2 are located outside of the rectangular matrix. They are identified as bonus numbers by being disposed within a colored field 3*a*.

In FIG. 3, the bonus numbered spaces 2 are located outside of the rectangular matrix and are identified by a line 3*b* encircling the area in which the bonus numbers are disposed. FIG. 3 also shows a number of additional "free" spaces 5 disposed at various locations within the rectangular matrix.

Figure 4:
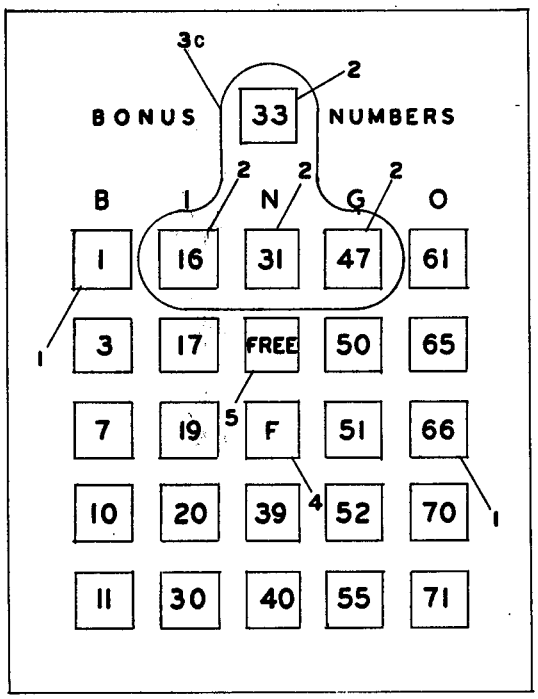

In FIG. 4, three bonus numbered spaces 2 are located within the rectangular matrix and one is located outside of the matrix. As in FIG. 3, the bonus numbers are identified by a line 3*c* encircling the area in which the bonus numbers are disposed.

With my invention, at least three additional games can be played while playing the ordinary game of bingo. For example, if a player covers a specified number of bonus numbers before a regular bingo is made, he can win a bonus prize. If the player who makes the regular bingo has additionally covered a specified number of bonus numbers, he also wins a bonus prize. A third bonus game can be played when the "coverall" game of bingo is being played. In this variation the first player who covers all of the bonus numbers on his board wins a bonus prize and continues playing until the end of the game.

While there has been described what is at present considered to be the preferred embodiments of the invention, it will be obvious to those skilled in the art that various changes and modifications may be made therein without departing from the spirit of the invention.

I claim:

1. In a bingo playing board comprising a front face having a rectangular matrix of spaces, at least a majority of said spaces being numbered spaces, said spaces being disposed in discrete rows and columns, and letters separately associated with and identifying respective ones of said columns, the arrangement constituting a conventional bingo game board format, wherein the improvement comprises the provision of means designating one or more of said numbered spaces as bonus numbers, whereby the covering of part or all of the bonus numbers in the course of a bingo game enables the playing of additional games along with the conventional bingo game.

2. In a bingo playing board as defined in claim 1 wherein said bonus number designating means is in the form of a line marking encircling the designated numbered spaces.

3. In a bingo playing board as defined in claim 1 wherein said numbered spaces are defined by numbers enclosed within geometric figures and the bonus number designating means is in the form of geometric figures enclosing said first recited geometric figures.

4. In a bingo playing board as defined in claim 1 including one or more additional numbered spaces on said face outside of said rectangular matrix and said designating means additionally designates said additional numbered spaces as bonus numbers, said designating means being in the form of a visually distinctive colored field encircling the bonus numbers.

5. In a bingo playing board as defined in claim 1 wherein said rectangular matrix of spaces includes one or more spaces which are designated as "free" spaces.

6. In a bingo playing board as defined in claim 1 including one or more additional numbered spaces on said face outside of said rectangular matrix and said designating means additionally designates said additional numbered spaces as bonus numbers, said designating means being in the form of a line marking encircling the designated bonus numbers, and further including means designating one or more of said spaces of said rectangular matrix as "free" spaces.

7. In a bingo playing board comprising a front face having a rectangular matrix of evenly spaced numbered spaces, said spaces being disposed is discrete rows and columns, and letters separately associated with an identifying respective ones of said columns, the arrangement constituting a conventional bingo game board format, wherein the improvement comprises one or more additional numbered spaces on said face outside of said rectangular matrix, and means designating said additional numbered spaces as bonus numbers, whereby the covering of part or all of the bonus numbers in the course of the playing of a bingo game enables the playing of additional games along with the conventional bingo game.

* * * * *